United States Patent [19]

Scott

[11] 4,150,251

[45] Apr. 17, 1979

[54] SCREW-ON WIRE CONNECTORS

[75] Inventor: William J. Scott, Sycamore, Ill.

[73] Assignee: Ideal Industries, Inc., Sycamore, Ill.

[21] Appl. No.: 911,382

[22] Filed: Jun. 1, 1978

Related U.S. Application Data

[60] Division of Ser. No. 602,440, Aug. 6, 1975, Pat. No. 4,112,251, which is a continuation of Ser. No. 162,533, Jul. 14, 1971, abandoned.

[51] Int. Cl.[2] ..... H01R 5/12

[52] U.S. Cl. ..... 174/87

[58] Field of Search ..... 174/87, 205; 339/95 B

[56] References Cited

U.S. PATENT DOCUMENTS

| | | | |
|---|---|---|---|
| 1,874,825 | 8/1932 | Sommer | 174/87 |
| 2,040,383 | 5/1936 | Jasper | 174/87 |
| 2,748,186 | 5/1956 | Lee | 174/87 |
| 2,844,806 | 7/1958 | McKissick | 339/95 B X |
| 3,132,202 | 5/1964 | Wolf | 174/87 |

FOREIGN PATENT DOCUMENTS

| | | | |
|---|---|---|---|
| 238017 | 8/1925 | United Kingdom | 174/205 |

*Primary Examiner*—Laramie E. Askin

*Attorney, Agent, or Firm*—Kinzer, Plyer, Dorn & McEachran

[57] ABSTRACT

A screw-on wire connector which includes an insulating cap with a bore open at one end for the reception of the stripped ends of wires. A distortable relatively non-expandable sheet metal wire retainer which receives the wires is located in the cap. The wire retainer has a tapered thread which engages the inserted wires. The wire retainer is spaced circumferentially from the inside of the wall of the cap between its ends to provide for circumferential distortion of the wire retainer by the wires without placing an outward load on the cap due to substantial contact between the wire retainer and the cap.

3 Claims, 2 Drawing Figures

Fig. 1.
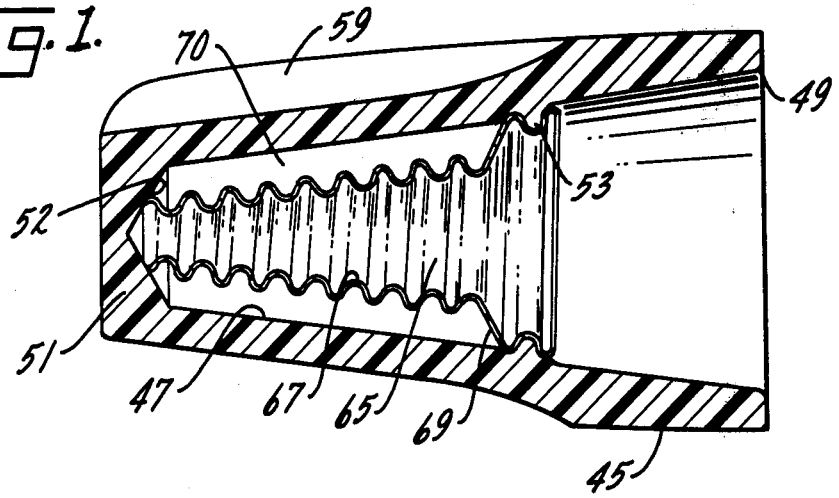
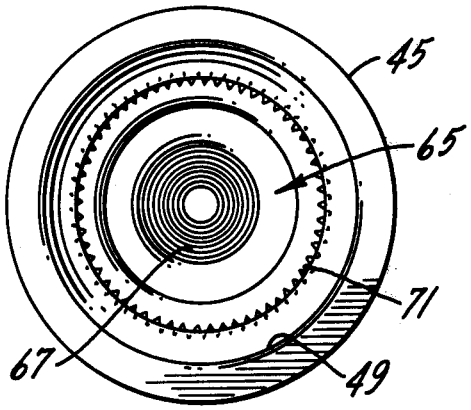
Fig. 2.

SCREW-ON WIRE CONNECTORS

This application is a division of application Ser. No. 602,440 filed Aug. 6, 1975, now U.S. Pat. No. 4,112,251 issued Sept. 5, 1978 which is a continuation of application Ser. No. 162,533 filed July 14, 1971, now abandoned.

SUMMARY OF THE INVENTION

This invention is concerned with a screw-on connector for making an electrical connection between wires.

An object of this invention is an electrical connector for making a connection between wires in which the bursting forces exerted by the wires being connected are absorbed by distortion of a wire retainer.

Another object is an electrical connector for making an electrical connection between the stripped ends of electrical wires in which the forces exerted by the electrical wires being connected are not transferred to the insulating means of the finished connection.

Another object is an electrical connector having an insulating cap in which the insulating cap does not absorb the bursting forces exerted by the wires being connected.

Another object is an electrical connector of the screw-on type in which the insulating cap may be formed with relatively thin walls and has a relatively small volume for the size of the connection.

Another object is an electrical connector having characteristics equal to those of a so-called "free spring" connector but which does not require the high strength and high quality wire used in a "free spring" connector.

Another object is an electrical connector of the screw-on type in which the wire connecting portion is not dependent upon the insulating portion for strength or form.

Another object is an electrical connector of the screw-on type which provides a wire connection of smaller volume than other types of screw-on connectors.

Another object is an electrical connector of the screw-on type which may be reused on any combination of wires within the design capability of the connector.

Another object is an electrical connector of the screw-on type having a sheet metal wire retainer.

Other objects may be found in the following specification, claims and drawings.

BRIEF DESCRIPTION OF THE DRAWINGS

The invention is illustrated more or less diagrammatically in the drawings wherein:

FIG. 1 is a longitudinal cross-sectional view taken through a screw-on wire connector embodying novel features of this invention; and FIG. 2 is an end view of a connector similar to the connector of FIG. 1 but having a modified wire retainer.

DESCRIPTION OF THE PREFERRED EMBODIMENT

One embodiment is shown in FIGS. 1 and 2 of the drawings. This connector includes an insulating cap or shell 45 which may be molded from a suitable thermosetting or thermoplastic or any suitable insulating material. A cavity or bore 47 is formed in the cap and tapers from an opening 49 at one end to a wall 51 closing the opposite end of the cap. A conical recess 52 may be formed in the wall 51 at the end of the bore. An annular ridge 53 may be formed in the bore inwardly of the opening 49. Longitudinally extending ribs 59 are formed on the exterior of the cap 45.

A sheet metal retainer 65 is positioned in the bore 47 with one end contacting the cone 52 in the end wall 51 of the cap and the other end seated on ridge 53. The retainer 65 is a generally frusto-conical shaped tubular member drawn from thin sheet metal and provided with rolled or hydraulically formed threads 67. The retainer is formed with a bell portion 69 at its larger end which engages the annular ridge 53 to support the main portion of the retainer in spaced relation to the wall of the cap 45 thereby creating a generally annular air space 70. The smaller end of the retainer 65 engages and is supported by the end wall 51 of the insulating cap in the conical recess 52. The bell portion of the wire retainer may be grooved or threaded to engage the ridge 53 or, as shown in FIG. 2 of the drawings, it may be provided with serrations 71. The serrations are particularly useful in attaching a wire retainer to a thermoplastic insulating cap since the serrated portion of the wire retainer may be fused to the insulating cap by means of heat or ultrasonics.

The use, operation and function of this invention are as follows:

This invention is directed to an electrical connector for making an electrical connection between the stripped ends of insulated electrical wires. In practice, the stripped ends of the wires are first bunched. The bunched stripped ends of the wires are then inserted in a distortable, relatively nonexpandable retainer having inwardly tapered threads. The retainer is suitably supported so that it may freely distort without contacting its support. The retainer is constructed so that it will distort or deform without substantial expansion. This may be accomplished by supporting the retainer in a wrench. Or the supporting member for the retainer may be in the shape of an insulating cap with the retainer and cap forming a unitary connector.

When the bunched ends of the wires are inserted in the retainer, the wires and the retainer are rotated relative to one another to feed the bunched wires into the retainer. During rotation, torque is applied to cause the retainer to compress the wires into contact with one another and to form a thread on them. During application of torque, the retainer freely distorts without substantial expansion to accommodate the wires as the bunched ends of the wires are forced into the small end of the retainer. The bursting forces exerted by the wires as they are compressed are absorbed by the distortion of the retainer and are not transmitted to the holder or shell. When the connection is made, the wires and the retainer may be covered with an insulator, although in some situations the provision of an insulator may not be necessary. Or the holder may also serve as an insulator.

The foregoing procedure may be practiced by the use of the screw-on wire connector which has been shown and described herein. The connector cap functions to support the retainer during insertion of the stripped ends of the bunched wires into the retainer. Also, the insulator cap eliminates the additional step of covering the joined wires and wire retainer with an insulator. When an insulator cap is provided as part of a screw-on connector, an air space is provided between the wire and the cap. It may be desirable in some situations to place a resilient material in the air space. The tendency of the retainer to deform may be varied by controlling the section thickness, section shape, material hardness, material strength, or diameter of the material forming the wire retainer or the included angle of the cone-shaped wire retainer. Also, the nature of the conductors being joined will affect the tendency of the retainer to deform.

Retainers of the type shown and described herein are not dependent upon insulating caps for strength or form. In prior art connectors in which a helically wound spring is directly supported throughout by an insulating cap, the cap or shell is required to be excessively strong to resist the considerable bursting forces developed by screwing the wires into the helically wound spring. The manufacture of such a connector requires thick sections in the insulating cap which are difficult to mold. An insulator cap with thick sections also occupies a larger cubic volume than the volume required by the connector of this invention. This presents problems in small outlet and device boxes.

The connector of this invention also provides advantages not found in the so-called free spring connector where the insulating cap does not radially support the spring and the spring is free to expand radially and contract longitudinally as the wires are inserted. However, the free spring connector requires a wire of greater strength and quality and consequently greater cost than the retainer necessary for the connector of this invention. Further, free spring connectors now in use are made from nonround wire which presents a small radius to the wires being connected. This also adds to the cost of the free spring connector and increases the difficulty in forming the spring or wire retainer. Also, the free spring connector will generally have the spring or wire retainer stretched beyond its elastic limit in the process of making a connection so that the connector cannot be reused on a joint with a smaller circular mil area.

The wire retainer 65 is a threaded sheet metal cup which may be formed by an electrical field of force, hydraulics, high energy rate forming, spinning, hot forging, cold forging or cold forming and brazing. In certain situations and for certain applications, the retainer may be made by investment casting or sintering or interior tapered threads may be machined after the wire retainer. The insulator cap can be formed with walls as thin and as uniform in thickness as possible to reduce the material used and the molding time.

One of the advantages of the present invention is that the method of manufacture is greatly simplified and a number of functions can be acquired in one step.

Whereas preferred forms of the invention have been described and shown, it should be understood that there are modifications, alterations and changes which may be made without departing from the teachings of the invention. Therefore, the scope of the invention should be only limited by the claims attached hereto.

The embodiments of the invention in which an exclusive property or privilege is claimed are defined as follows:

1. In an electrical connector for joining the stripped ends of two or more electrical wires, a circumferentially distortable relatively nonexpandable retainer for receiving the stripped ends of the wires and being generally tapered between an open larger end and a closed smaller end with an open interior therebetween, a thread-forming surface on the open interior of the retainer, and exterior means on the retainer for transmitting wire connecting torque to the retainer to cause the thread-forming surface on the open interior thereof to be turned down on and thread the stripped ends of the wires, the retainer being in the form of a thin sheet metal generally frusto-conical, somewhat tubular-shaped member with threads formed therein.

2. The structure of claim 1 further characterized in that the sheet metal member has an annular groove at its larger end which is in snap-fit relation with an annular ridge in the exterior means which holds them together.

3. The structure of claim 1 further characterized in that the exterior means includes an insulating cap which is open at one end and closed at the other, the sheet metal member having a series of serrations which engage and dig into the inner surface of the cap.

* * * * *